US009253576B2

(12) United States Patent
Tripp et al.

(10) Patent No.: US 9,253,576 B2
(45) Date of Patent: Feb. 2, 2016

(54) SUSPENSION FOR ACOUSTIC DEVICE

(71) Applicant: Bose Corporation, Framingham, MA (US)

(72) Inventors: Zachariah E. Tripp, Milford, NH (US); Daniel J. Sheehan, Holliston, MA (US); Timothy Benjamin Stonelake, Cambridge, MA (US)

(73) Assignee: Bose Corporation, Framingham, MA (US)

( * ) Notice: Subject to any disclaimer, the term of this patent is extended or adjusted under 35 U.S.C. 154(b) by 149 days.

(21) Appl. No.: 14/086,284

(22) Filed: Nov. 21, 2013

(65) Prior Publication Data

US 2015/0139477 A1 May 21, 2015

(51) Int. Cl.

| | |
|---|---|
| ***H04R 1/00*** | (2006.01) |
| ***H04R 9/04*** | (2006.01) |
| ***H04R 7/16*** | (2006.01) |
| ***H04R 7/18*** | (2006.01) |
| *H04R 7/00* | (2006.01) |

(52) U.S. Cl.
CPC .. *H04R 9/04* (2013.01); *H04R 7/16* (2013.01); *H04R 7/18* (2013.01)

(58) Field of Classification Search
CPC ..... H04R 1/021; H04R 1/22; H04R 7/04; H04R 7/06; H04R 7/12; H04R 7/14; H04R 7/16; H04R 7/18; H04R 7/20; H04R 7/122; H04R 9/06; H04R 9/025; H04R 9/043; H04R 9/063; H04R 31/006; H04R 2307/207; H04R 2400/03
USPC ..... 181/171, 172, 173, 174; 381/150, 396, 381/398
See application file for complete search history.

(56) References Cited

U.S. PATENT DOCUMENTS

| | | | |
|---|---|---|---|
| 1,859,782 | A | 5/1932 | May |
| 5,371,805 | A | 12/1994 | Saiki et al. |
| 5,590,211 | A | 12/1996 | Chang |
| 6,516,077 | B1 | 2/2003 | Yamaguchi et al. |
| 6,567,528 | B1 | 5/2003 | Heed |
| 6,611,604 | B1 | 8/2003 | Irby et al. |
| 6,655,495 | B2 | 12/2003 | Kuze et al. |
| 6,697,496 | B2 | 2/2004 | Frasl |
| 6,725,967 | B2 | 4/2004 | Hlibowicki |
| 6,851,513 | B2 | 2/2005 | Stead et al. |
| 6,889,796 | B2 | 5/2005 | Pocock et al. |

(Continued)

FOREIGN PATENT DOCUMENTS

| | | | |
|---|---|---|---|
| DE | 10058274 | A1 | 5/2002 |
| DE | 102006058369 | A1 | 6/2008 |

(Continued)

OTHER PUBLICATIONS

International Search Report and Written Opinion dated Jan. 28, 2015 for International application No. PCT/ US2014/061009.

*Primary Examiner* — Brian Ensey

(57) ABSTRACT

An apparatus includes a suspension element coupling a first rigid element to a second rigid element such that the first rigid element is movable in a reciprocating manner relative to the second rigid element. The suspension element includes radial features, some of which may have radial segments of opposite concavity. The segments with opposite concavity provide added stiffness in the primary axis of vibration and may contribute to a more symmetrical force-deflection relationship.

36 Claims, 13 Drawing Sheets

(56) References Cited

U.S. PATENT DOCUMENTS

| | | | | |
|---|---|---|---|---|
| 6,920,957 | B2 | 7/2005 | Usuki et al. | |
| 6,957,714 | B2 | 10/2005 | Takahashi et al. | |
| 7,054,459 | B2 * | 5/2006 | Kuze et al. | 181/172 |
| 7,174,990 | B2 | 2/2007 | Stead et al. | |
| 7,275,620 | B1 | 10/2007 | Diedrich et al. | |
| 7,306,073 | B2 | 12/2007 | Frasl | |
| 7,319,766 | B2 | 1/2008 | Hall et al. | |
| 7,397,927 | B2 | 7/2008 | Pircaro et al. | |
| 7,416,047 | B2 | 8/2008 | Frasl et al. | |
| 7,428,946 | B2 | 9/2008 | Honda et al. | |
| 7,438,155 | B2 | 10/2008 | Stead et al. | |
| 7,480,390 | B2 * | 1/2009 | Tabata et al. | 181/172 |
| 7,699,139 | B2 | 4/2010 | Subramaniam et al. | |
| 7,706,562 | B2 | 4/2010 | Ohara | |
| 7,711,137 | B2 | 5/2010 | Optiz | |
| 7,801,324 | B2 | 9/2010 | Kimura et al. | |
| 7,866,439 | B2 | 1/2011 | Windischberger et al. | |
| 7,916,890 | B2 | 3/2011 | Irby et al. | |
| 7,931,115 | B2 | 4/2011 | Silver | |
| 7,946,378 | B2 | 5/2011 | Windischberger et al. | |
| 8,023,688 | B2 | 9/2011 | Irby et al. | |
| 8,094,864 | B2 | 1/2012 | Inaba et al. | |
| 8,139,812 | B2 | 3/2012 | Basnet et al. | |
| 8,215,445 | B2 | 7/2012 | Wildhagen et al. | |
| 8,340,340 | B2 | 12/2012 | Bogdanov et al. | |
| 8,345,916 | B2 | 1/2013 | Schulze et al. | |
| 8,397,861 | B1 | 3/2013 | Xu et al. | |
| 8,411,894 | B2 | 4/2013 | Opitz | |
| 2002/0170773 | A1 | 11/2002 | Stead et al. | |
| 2003/0231784 | A1 | 12/2003 | Kuze et al. | |

FOREIGN PATENT DOCUMENTS

| | | | |
|---|---|---|---|
| EP | 1659823 | A2 | 5/2006 |
| EP | 2454890 | B1 | 9/2013 |
| GB | 2344248 | A | 5/2000 |
| JP | 4031977 | B2 | 1/2008 |
| JP | 4830761 | B2 | 1/2008 |
| JP | 4264579 | B2 | 5/2009 |
| JP | 4513220 | B2 | 7/2010 |
| WO | 03009640 | A2 | 1/2003 |
| WO | 2011007151 | A2 | 1/2011 |

* cited by examiner

SUSPENSION FOR ACOUSTIC DEVICE

BACKGROUND

This disclosure relates generally to an acoustic source, and more particularly to a suspension element associated with an acoustic source.

SUMMARY

In accordance with an aspect, an apparatus comprises first and second rigid elements and a suspension element which couples the first rigid element to the second rigid element such that the first rigid element is movable in a reciprocating manner relative to the second rigid element. The suspension element comprises a concave surface, a convex surface, and at least first and second radial segments of opposite concavity, the first segment extending away from the concave surface and the second segment extending away from the convex surface.

In some implementations the first and second radial segments are oriented such that lines which bisect the segments lengthwise are tangential to a circle with a radius less than an inner radius of the suspension element.

In some implementations the apparatus further comprises a first radial feature comprising the first and second radial segments of opposite concavity.

In some implementations the apparatus further comprises a second radial feature which extends away from the concave surface.

In some implementations the first and second radial features traverse a semi-circular roll of the suspension element.

In some implementations the first and second radial features are presented in alternation.

In some implementations the second radial segment extends from an apex of the roll to an outer edge of the roll.

In some implementations the second radial segment is characterized by a curved cross-section with a minimum height proximate to the apex of the roll and a maximum height proximate to the outer edge of the roll.

In some implementations the first radial segment extends from an inner edge of the roll to the apex of the roll.

In some implementations the first radial segment is characterized by a curved cross-section with a maximum depth proximate to a midpoint between the apex of the roll and an inner edge of the roll.

In some implementations the second radial feature is characterized by a curved cross-section with a maximum depth proximate to the apex of the roll.

In some implementations the first and second radial features span only a portion of the distance between an inner edge and outer edge of the roll.

In some implementations the suspension element comprises a rolled shape.

In some implementations the rolled shape comprises two or more rolls.

In some implementations the first and second radial features are spaced regularly along the suspension element.

In some implementations the second radial feature has a depth that varies along a length of the second radial feature.

In some implementations the suspension element comprises a surround.

In some implementations the suspension element comprises a spider.

In some implementations a material thickness of the second radial segment varies along a length of the second radial segment.

In some implementations the thickness of the second radial segment is greatest at the portion of the second radial segment proximate to an outer edge of the roll.

In accordance with an aspect, an apparatus comprises a diaphragm, a frame, and a suspension element which couples the diaphragm to the frame such that the diaphragm is movable in a reciprocating manner relative to the frame. The suspension element comprises a roll which defines a concave surface and a convex surface. The roll comprises at least one feature having inner and outer ends proximate to an inner edge of the roll and an outer edge of the roll, respectively, and first and second segments of opposite concavity, the first segment extending away from the concave surface and the second segment extending away from the convex surface.

In some implementations the first feature comprises the first and second segments of opposite concavity.

In some implementations the roll further comprises a second feature which extends away from the concave surface.

In some implementations the first and second features are oriented such that lines which bisect the features lengthwise are tangential to a circle with a radius less than an inner radius of the suspension element.

In some implementations the second segment extends from an apex of the roll to an outer edge of the roll.

In some implementations the second segment is characterized by a curved cross-section with a minimum height proximate to the apex of the roll and a maximum height proximate to the outer edge of the roll.

In some implementations the first segment is characterized by a curved cross-section with a maximum depth proximate to a midpoint between the apex of the roll and an inner edge of the roll, and minimum depths proximate to the apex of the roll and the inner edge of the roll.

In some implementations the second feature is characterized by a curved cross-section with a maximum depth proximate to the apex of the roll, and minimum depths proximate to the inner edge of the roll and the outer edge of the roll.

In some implementations the first and second features are presented in alternation.

In accordance with an aspect, a loudspeaker suspension comprises a loudspeaker suspension structure having an inner circumferential border and an outer circumferential border, and a first feature extending from the inner circumferential border to the outer circumferential border, wherein the first feature comprises a first segment having a first concavity and a second segment having a second concavity, the second concavity being an inverse of the first concavity.

In some implementations the loudspeaker suspension further comprises a second feature extending from the inner circumferential border to the outer circumferential border and having the first concavity.

In some implementations, the first and second features are oriented such that lines which bisect the features lengthwise are tangential to a circle with a radius less than an inner radius of the suspension structure.

In some implementations the first and second features are presented in alternation.

In some implementations the suspension structure comprises a roll.

In some implementations the first feature transitions from the first concavity to the second concavity proximate to an apex of the roll.

In some implementations the first and second features span only a portion of the distance between the inner circumferential border and the outer circumferential border.

In accordance with another aspect an apparatus comprises: means for coupling a first rigid element to a second rigid element such that the first rigid element is movable in a reciprocating manner relative to the second rigid element, the coupling means comprising first and second radially oriented features of opposite concavity.

BRIEF DESCRIPTION OF THE FIGURES

For purposes of illustration some elements are omitted and some dimensions are exaggerated.

DETAILED DESCRIPTION

Figure 1:
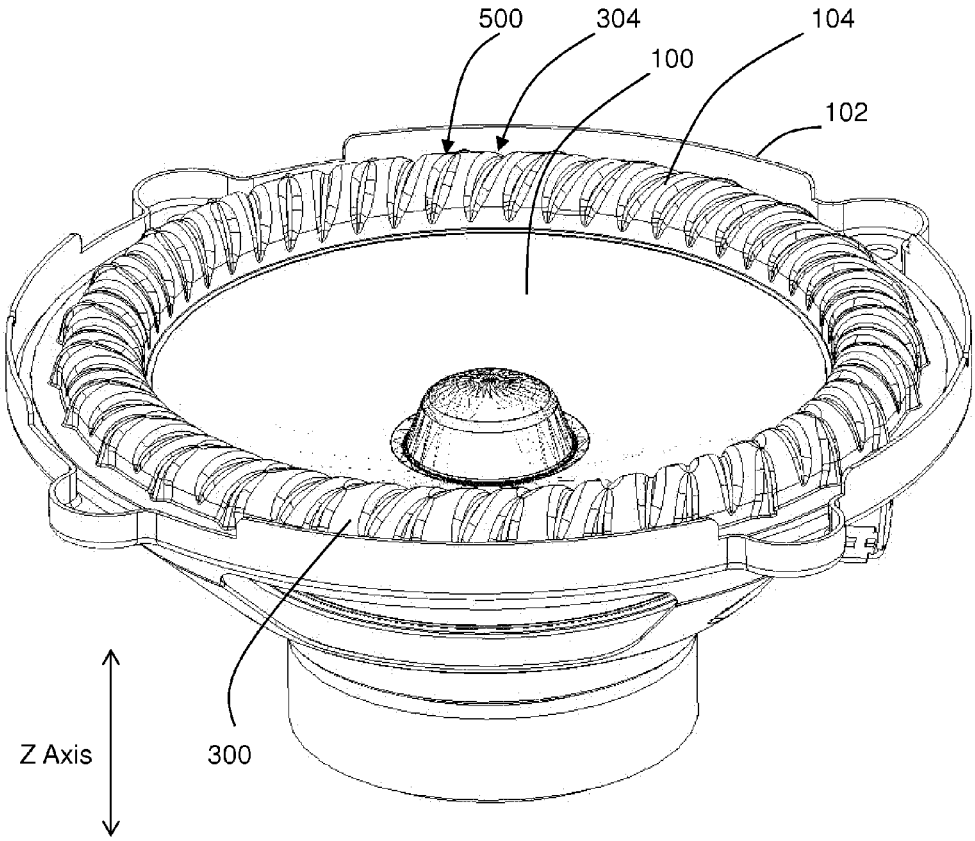
FIG. 1 is a perspective view of an acoustic device with a suspension element characterized by radial features with variations of concavity.

FIG. 1 illustrates an acoustic device such as a loudspeaker, driver or transducer. The acoustic device includes a diaphragm 100 (sometimes referred to as a cone, plate, cup or dome) coupled to a frame 102 via a suspension element 104 sometimes referred to as a surround. However, the features described herein could be utilized in a spider or other suspension element. The diaphragm may be circular or non-circular in shape. For example, and without limitation, the diaphragm could be an ellipse, square, rectangle, oblong, or racetrack. The frame may be coupled to an enclosure (not illustrated). The suspension element 104 allows the diaphragm 100 to move in a reciprocating manner relative to the frame 102 and enclosure in response to an excitation signal provided to a motor that outputs a force to diaphragm 100. Movement of the diaphragm causes changes in air pressure which result in production of sound.

Figure 2:
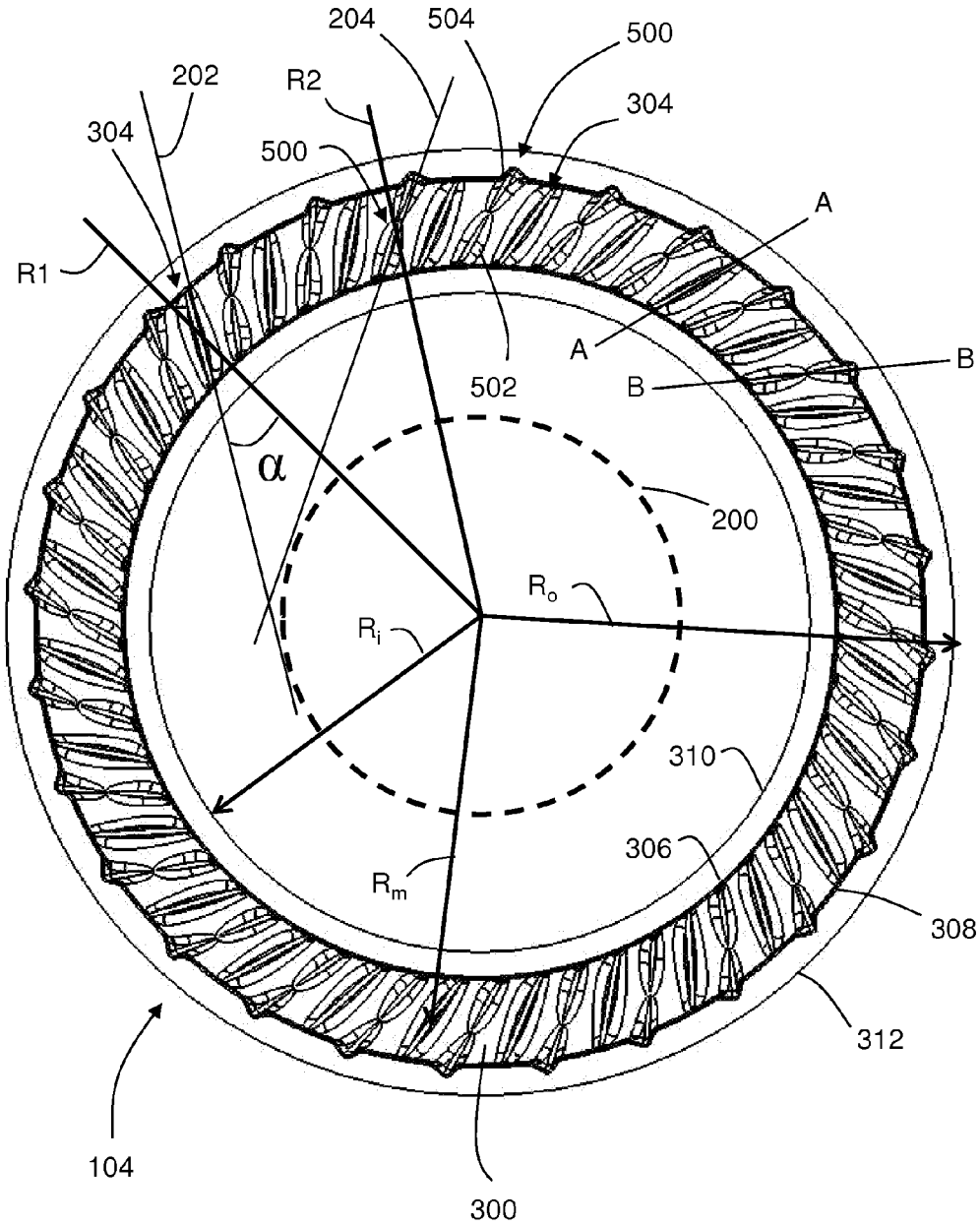
FIG. 2 is a top view of the suspension element of FIG. 1.

In some examples, as shown in FIGS. 1 and 2, the suspension element 104 is a circular half roll having an inner edge 306 and an outer edge 308, separated by a radial width or span. The suspension element 104 can include an inner landing 310 extending radially inward from the inner edge 306 and an outer landing 312 extending radially outward from the outer edge 308 for connection to the diaphragm 100 and frame 102, respectively. The half roll may have a convex surface 300 facing away from the interior of the enclosure, and a concave surface 302 (shown in FIGS. 3 and 4) facing toward the interior of the enclosure. Although the suspension element 104 is shown as a half roll having a single convolution, the suspension element 104 could be, without limitation, a full roll, an inverted half roll (i.e., flipped over 180 degrees), or a roll having multiple convolutions, and could include variations of concavity and other features. A convolution as used herein comprises one cycle of a possibly repeating structure, where the structure typically comprises concatenated sections of arcs. The arcs are generally circular, but can have any curvature. Although the suspension element 104 is shown as circular in shape, the suspension element 104 could also be non-circular in shape. For example, without limitation, the suspension element 104 could be an ellipse, toroid, square, rectangle, oblong, racetrack, or other non-circular shapes. In places where the terms circumferential, radial, or other circle-specific terminology is mentioned, it should be understood that we also mean to encompass non-circular geometries.

The suspension element 104 includes rib and groove features which may enhance axial stiffness, free length, force-deflection relationships, and buckling resistance, and may reduce the overall mass of the suspension element. For example, the suspension element 104 may include one or more radial rib features, groove features, and rib-and-groove features. Examples of these features are described below.

Referring to FIG. 2, suspension element 104 includes radial groove (or trench) features 304 and radial rib-and-groove features 500. The groove features 304 and rib-and-groove features 500 generally extend from an inner edge 306 to an outer edge 308 of the roll. In other examples, the groove features 304 and rib-and-groove features 500 need not extend over the entire span from the inner edge 306 to the outer edge 308.

In some examples, the groove features 304 and rib-and-groove features 500 generally extend at an angle to the radial direction, or more generally, at an angle to the normal of the inner edge 306 of the suspension element 104, at the point of the groove or rib-and-groove closest to the inner edge 306. In other words, the groove features 304 may be radially oriented such that line 202 which bisects the groove features 304 lengthwise is tangential to a circle with a radius less than the inner radius ($R_i$) of the suspension element 104. Similarly, the rib-and-groove features 500 may be radially oriented such that line 204 which bisects the rib-and-groove features 500 lengthwise is tangential to a circle with a radius less than the inner radius ($R_i$) of the suspension element 104.

As shown in FIG. 2, each groove feature 304 and rib-and-groove feature 500 may be skewed by an angle alpha (a) relative to radius lines R1, R2 which are normal to the inner edge of the suspension element 104. For example, alpha represents the angle between line 202 and radius line R1 in FIG. 2. Alpha can vary over a wide range, and need not be the same for the groove features 304 and the rib-and-groove features 500. Where the path of the groove feature 304 or rib-and-groove feature 500 traverses a substantially straight line from inner edge to outer edge, the angle alpha is preferably between 30 and 60 degrees (or −30 to −60 degrees), although useful behavior is obtained with an angle between 10 and 80 degrees (or −10 to −80 degrees). Negative angles of alpha refer to groove features 304 or rib-and-groove feature 500 that incline in the opposite direction from the radial (or normal) to that shown in FIG. 2. Groove features 304 and rib-and-groove features 500 can be straight or curved. The radius of curvature along the length of the groove or rib-and-groove can be infinite (i.e. a straight line), a finite constant, or smoothly or otherwise varying. For examples with constant, smoothly or otherwise varying curvature, alpha can vary between 0 and 90 degrees.

Figure 3:
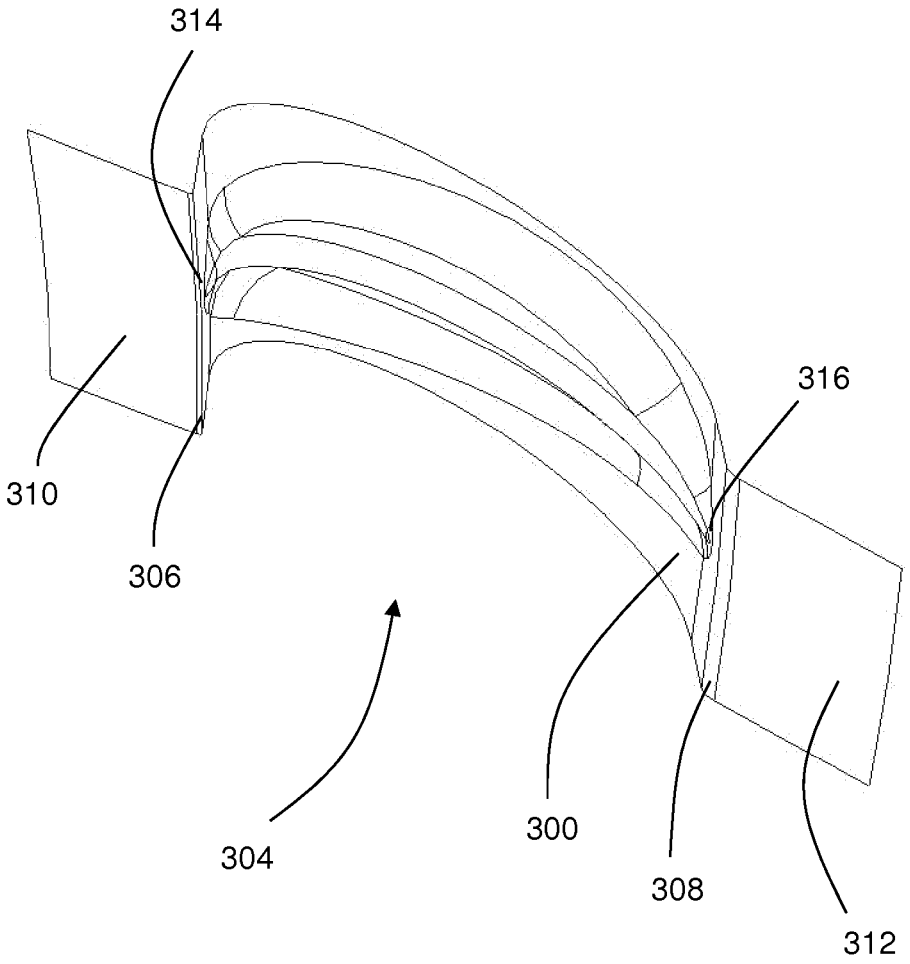
FIG. 3 illustrates a groove feature of the suspension element of FIG. 1.
Figure 4:
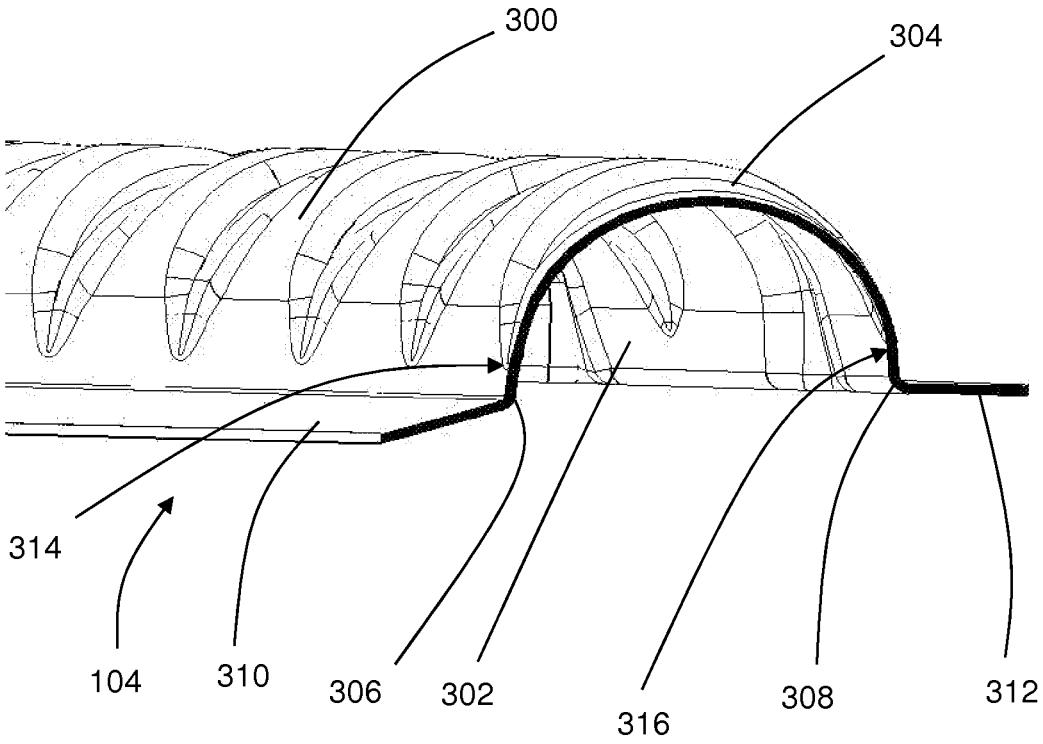
FIG. 4 is a cross-sectional view of a groove feature of the suspension element of FIG. 2 along section A-A.

Referring to FIGS. 3 and 4, the groove features 304 are further described. Groove features 304 extend outward from the concave surface 302 of the roll toward the interior of the enclosure. Groove features 304 may traverse the roll from approximately an inner edge 306 to an outer edge 308 of the roll. In other words, inner end 314 and outer end 316 of the groove feature 304 may be proximate to the inner landing 310 and outer landing 312 of the suspension element 104, respectively. Alternatively, groove features 304 may traverse the roll from a point offset from the inner edge 306 to a point offset from the outer edge 308, or onto the inner and/or outer landings 310, 312.

Figure 5:
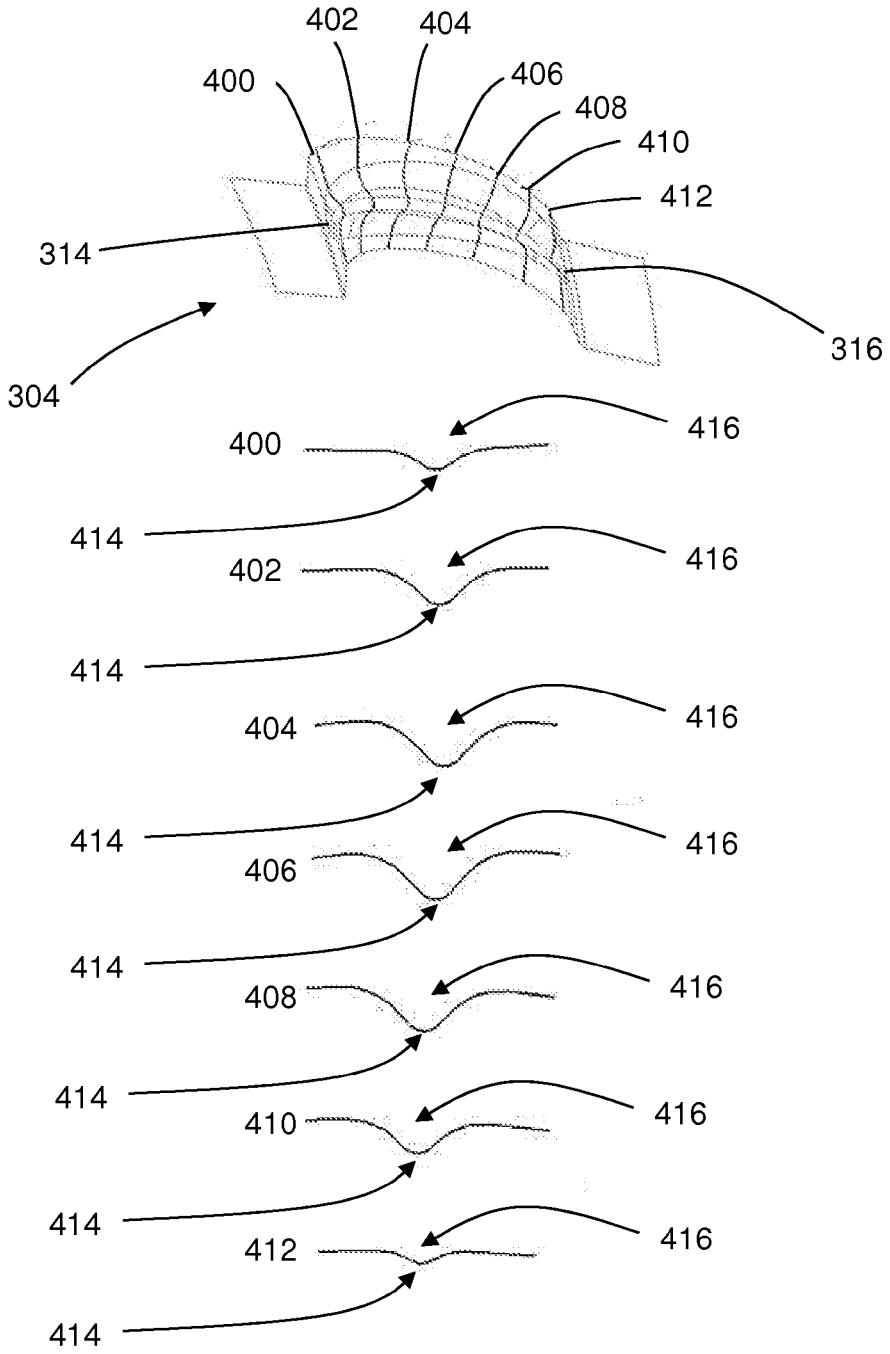
FIG. 5 is an expanded view of the groove feature of FIG. 3 including a series of cross-sections.

FIG. 5 is an expanded view of a groove feature 304 including a series of cross-sections 400, 402, 404, 406, 408, 410, 412. As shown in the cross-sections, the groove feature 304 may include a curved trough or a generally V-shaped notch 416 with a rounded tip 414 that extends downward from the concave surface 302 of the roll toward the interior of the enclosure. Various geometries are possible for the notch, including without limitation a square-shaped notch with rounded edges. Other geometric aspects of the notch, including the curvature and angle of the notch and the radius of the rounded tip, may be constant or may vary along the length of the groove feature 304. The depth of the groove feature 304 relative to the roll may vary as the notch traverses from the inner edge 306 to the outer edge 308 of the roll. For example, the depth of the groove feature 304 may range from zero depth at ends 314, 316 to a maximum depth somewhere between the ends 314, 316. In one example, the maximum depth may be located at radius $R_m$ (as shown in FIG. 2), which is the midpoint between the inner and outer edges 306, 308 of the roll. In other words, the groove defined by groove feature 304 may be deepest proximate to the apex of the roll. A transition radius may be provided at the boundary between the groove feature 304 and the roll, in lieu of sharp edges. It should be understood that a wide variety of variations could be implemented and symmetry need not be maintained. For example, the point where the groove is deepest may vary. Moreover, in some examples, the groove depth may remain constant over a large portion of the length of the groove. In other examples, the groove depth may have a plurality of local maxima and minima along the groove path, forming undulations in the bottom of the groove, which could help minimize the impact of "pull up" due to stiffening of the suspension element at the extremes of the excursion path.

Figure 6A:
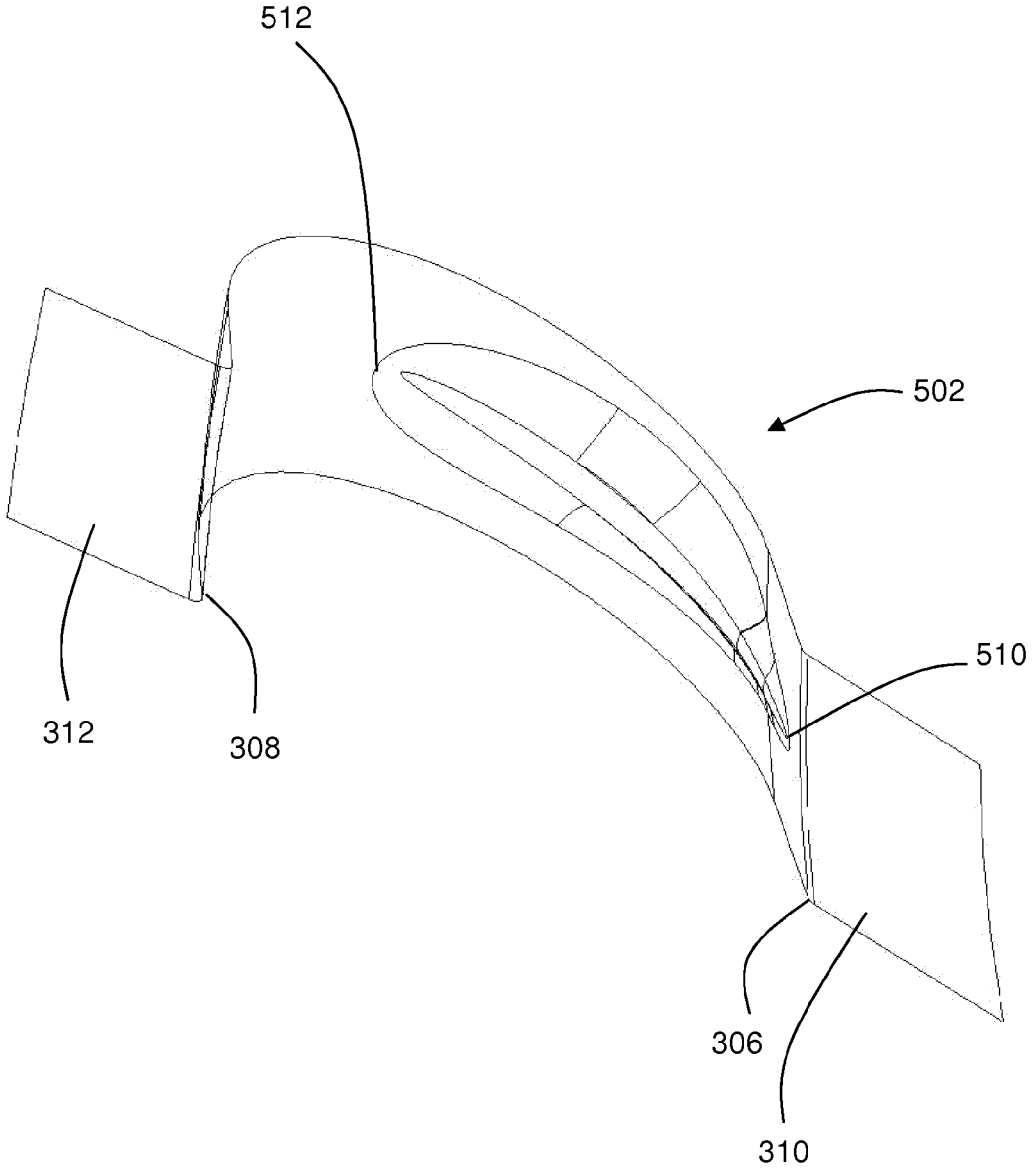
FIG. 6A illustrates a groove portion of a rib-and-groove feature of the suspension element of FIG. 1.
Figure 6B:
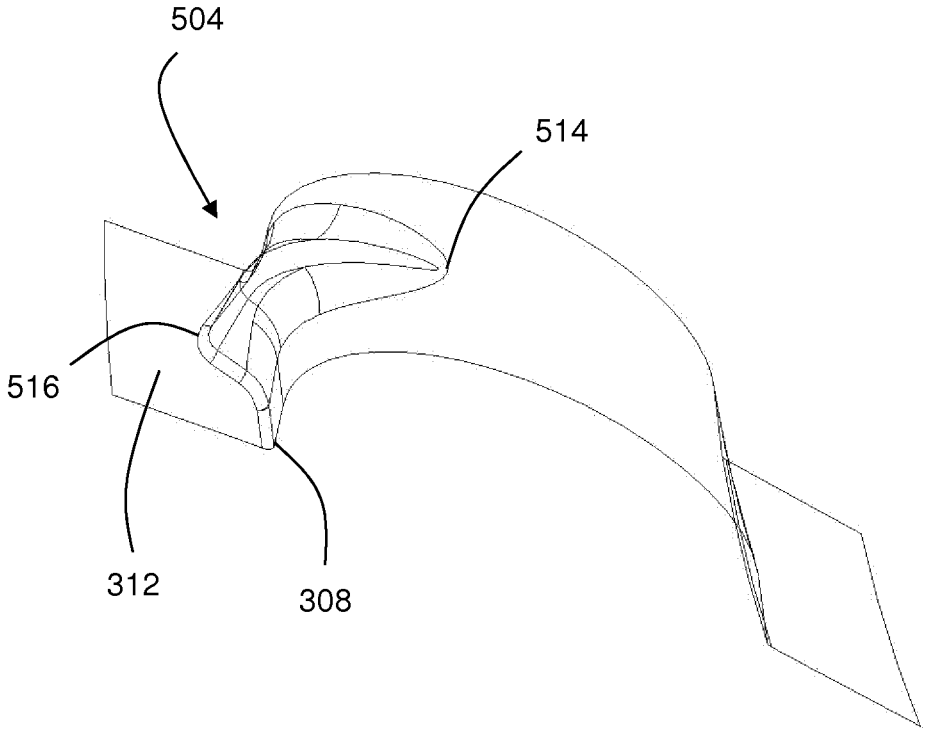
FIG. 6B illustrates a rib portion of a rib-and-groove feature of the suspension element of FIG. 1.
Figure 6C:
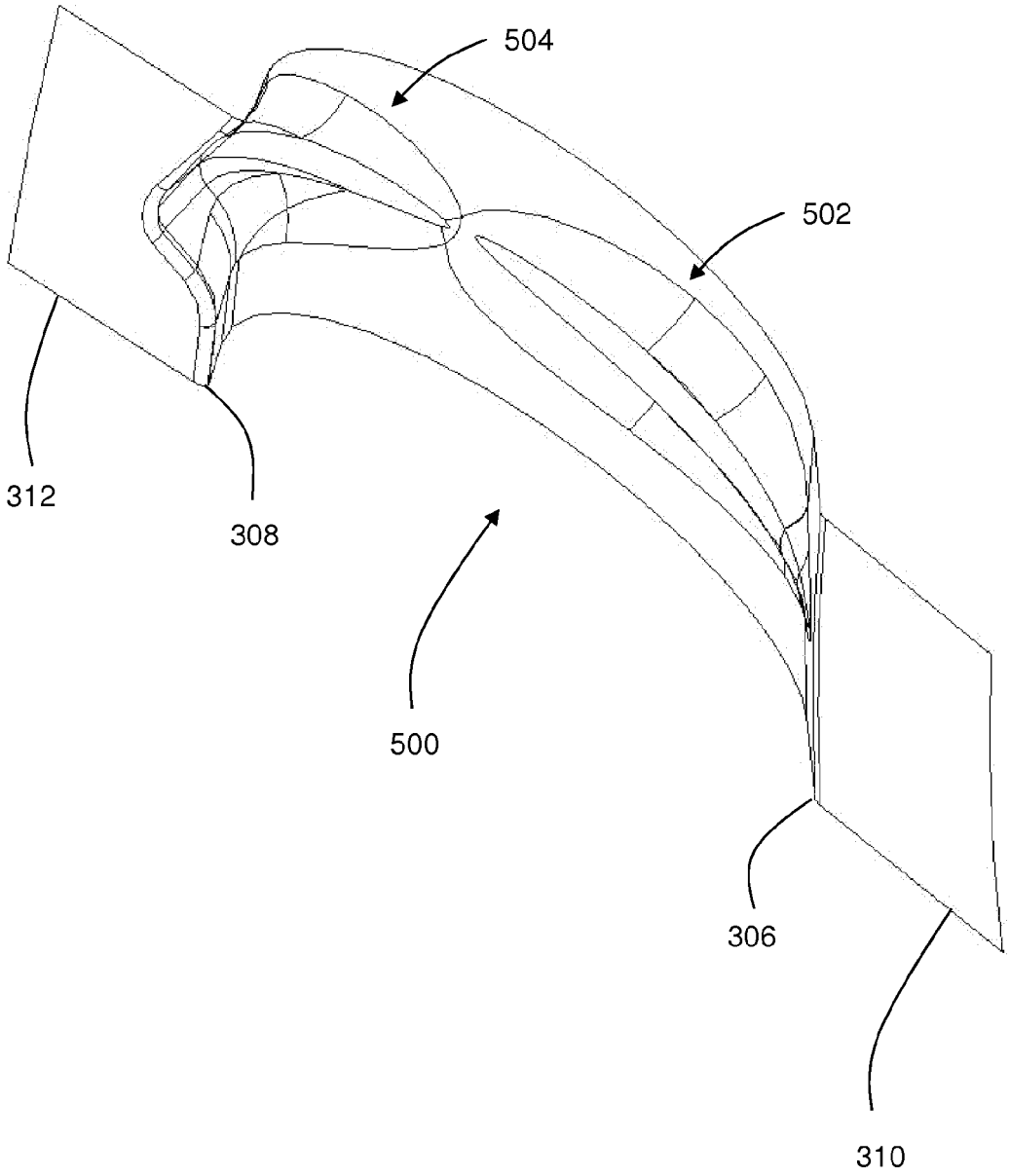
FIG. 6C illustrates a rib-and-groove feature of the suspension element of FIG. 1.
Figure 7:
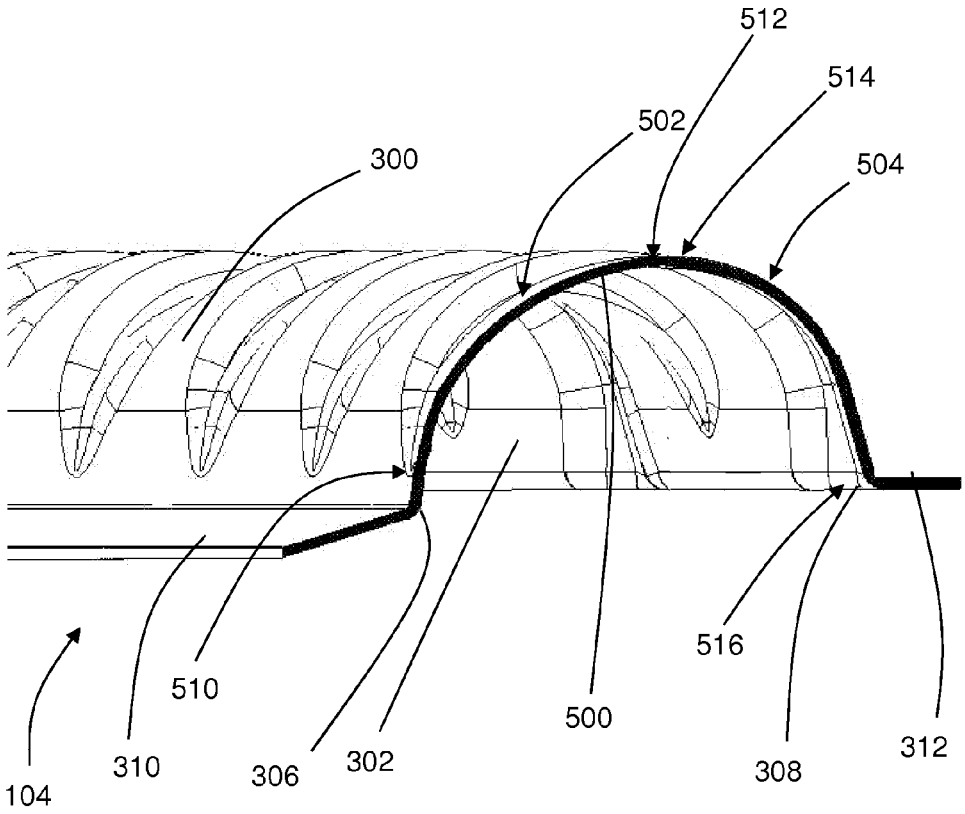
FIG. 7 is a cross-sectional view of a rib-and-groove feature of the suspension element of FIG. 2 along section B-B.

Referring to FIGS. 6 and 7, the rib-and-groove features 500 are further described. Rib-and-groove features may include an inner segment 502 and an outer segment 504. As shown in FIG. 6A, the inner segment 502 may extend outward from the concave surface 302 of the suspension element toward the interior of the enclosure, thereby presenting a groove in the convex surface of the suspension element 104. The outer segment 504 defines an inflexion of concavity relative to the inner segment 502. In other words, if the inner segment 502 is concave when facing the interior of the enclosure, the outer segment 504 is convex when facing the interior of the enclosure. As shown in FIG. 6B, the outer segment 504 extends outward from the convex surface 300 of the suspension element toward the exterior of the enclosure, thereby presenting a rib in the convex surface of the suspension element 104. FIG. 6C shows the inner segment 502 of FIG. 6A (the groove portion) combined with the outer segment 504 of FIG. 6B (the rib portion) which together form a rib-and-groove feature 500. Although the examples shown in FIGS. 6A-6C show a groove for the inner segment 502 and a rib for the outer segment 504, other examples may include a rib for the inner segment 502 and a groove for the outer segment 504.

The rib-and-groove features 500 may traverse the roll from approximately the inner edge 306 to the outer edge 308 of the roll. In other words, inner end 510 and outer end 516 of the rib-and-groove feature 500 may be proximate to the inner landing 310 and outer landing 312 of the suspension element. Alternatively, rib-and-groove features 500 may traverse the roll from a point offset from an inner edge 306 to a point offset from an outer edge 308, or onto the inner and/or outer landings 310, 312. In some examples, inner and outer ends 510, 512 of the inner segment 502 (the groove portion) may be proximate to the inner edge 306 of the roll and the apex of the roll ($R_m$), respectively, while inner and outer ends 514, 516 of the outer segment 504 (the rib portion) may be proximate to the apex of the roll ($R_m$) and the outer edge 308 of the roll, respectively. However, other locations are contemplated for inner and outer ends 510, 512, 514, 516. For example, for the inner segment 502 (the groove portion), inner end 510 may be at a point offset from an inner edge 306 of the roll and outer end 512 may be at a point offset from the apex of the roll. Similarly, for the outer segment 504 (the rib portion) outer end 516 may be at a point offset from an outer edge 308 of the roll, and inner end 514 may be at a point offset from the apex of the roll.

In some examples, the rib-and-groove feature 500 transitions from the inner segment 502 (the groove portion) to the outer segment 504 (the rib portion) approximately at the apex ($R_m$) of the roll. However, this transition could occur at other locations on the roll. Moreover, in some examples, the outer end 512 of the inner segment 502 transitions directly into the inner end 514 of the outer segment 504. In other words, the groove transitions directly into a rib, so there is no overlap of, or gap between, the ends 512, 514 of the inner and outer segments. In other implementations, however, there could be a gap between the ends 512, 514 of the inner and outer segments.

Figure 8:
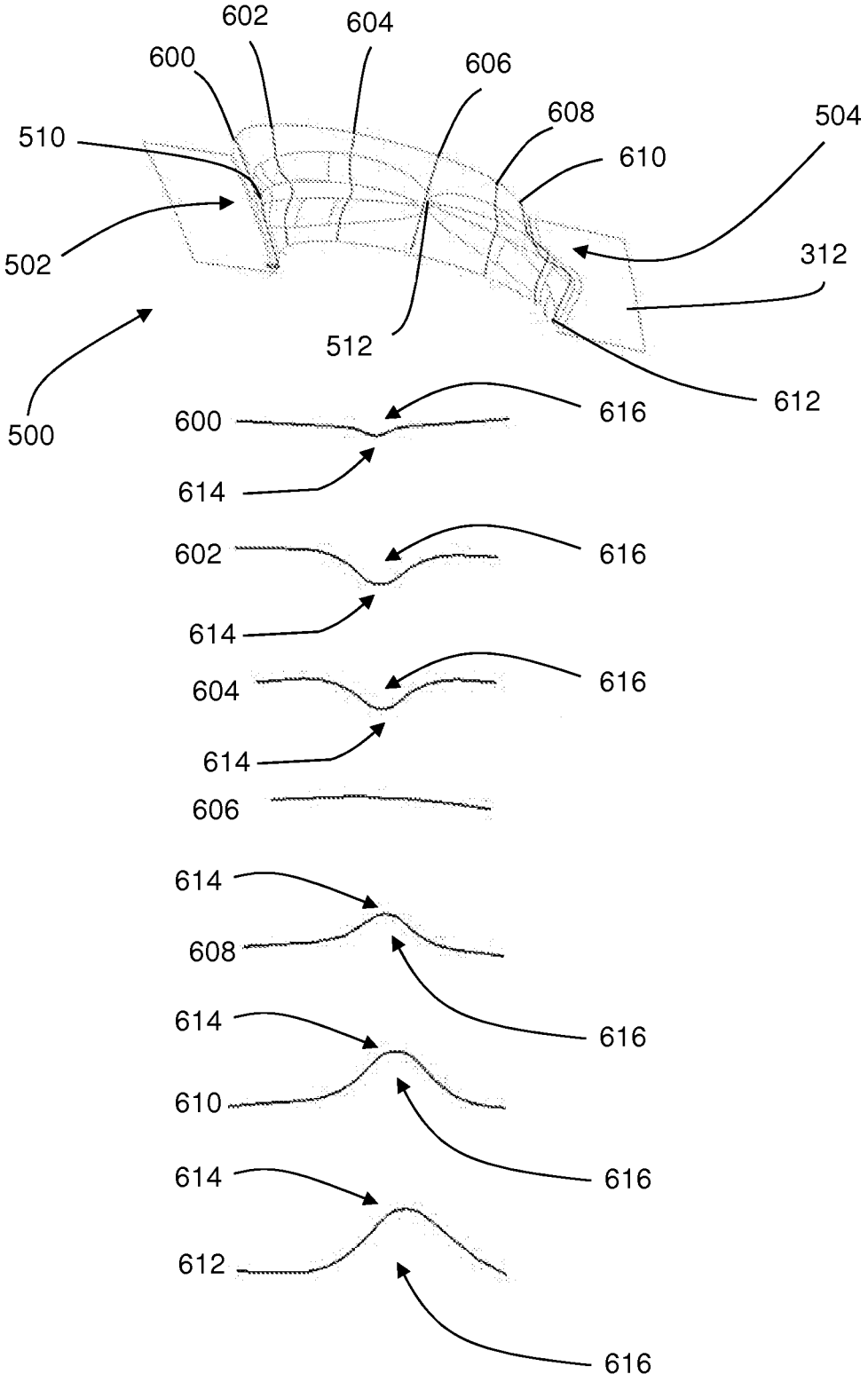
FIG. 8 is an expanded view of the rib-and-groove feature of FIG. 6C including a series of cross-sections.

FIG. 8 is an expanded view of a rib-and-groove feature 500 including a series of cross-sections 600, 602, 604, 606, 608, 610, 612. As shown in the cross-sections, the rib-and-groove feature 500 may include a curved trough or a generally V-shaped notch 616 with a rounded tip 614 that extends downward from the concave surface 302 of the roll toward the interior of the enclosure in the inner segment 502 (groove portion) and upward from the convex surface 300 of the roll away from the interior of the enclosure in the outer segment 504 (rib portion). Various geometries are possible for the notch, including without limitation a square-shaped notch with rounded edges. Other geometric aspects of the notch, including the curvature and angle of the notch and the radius of the rounded tip, may be constant or may vary along the length of the rib-and-groove feature 500. The depth and height of the rib-and-groove feature 500 relative to the roll may vary as the notch traverses from the inner edge 306 to the outer edge 308 of the roll. For example, the maximum depth of the inner segment 502 (the groove portion) may be at the midpoint between the inner edge 306 and the apex of the roll. In other words, the groove presented by the inner segment 502 may be deepest halfway between the apex and the inner edge 306. The maximum height of the outer segment 504 (the rib portion) may be at the outer edge 308 of the roll, and the minimum height may be at the inner end 514 (the end proximate to the apex of the roll). In other words, the rib presented by the outer segment 504 may be tallest at the outer edge 308 of the roll. A transition radius may be provided at the boundary between the rib-and-groove feature 500 and the roll, in lieu of sharp edges. It should be understood that a wide variety of variations could be implemented and symmetry need not be maintained. For example, the extent to which the inner and outer segments 502, 504 protrude from the concave and convex surfaces of the suspension element may vary. Further, the cross-sections of maximum and minimum height and depth between the inner segments and outer segments are not necessarily equal in magnitude, and the point where the inner segment 502 and outer segment 504 are deepest and tallest, respectively, may vary. Moreover, in some examples, the depth of the inner segment 502 and the height of the outer segment 504 may remain constant over a large portion of their length. In other examples, the inner and outer segments 502, 504 may have a plurality of local maxima and minima along their path.

The different types of radial features may be presented alone or in any combination, and in any suitable number, spacing, pattern and ratio. FIGS. 1 and 2, for example, illustrate a suspension element with radial groove features in alternation with radial rib-and-groove features. But a wide variety of modifications and variations of the radial features are possible. For example, a suspension element may have radial rib features in alternation with radial rib-and-groove features, or may have all three radial features (ribs, grooves and rib-and-groove features). Moreover, the radial features need not be presented in alternation, but could be presented in any proportion, e.g., rib-and-groove features 500 could be presented every third, fourth, fifth (or any suitable number) radial feature.

Adjacent ribs, grooves and/or rib-and-groove features are separated by a pitch distance, which can be defined as a circumferential distance taken at a specified radial distance from the origin. For convenience, the distance will be defined at the midpoint between the inner and outer edges of the suspension element. The pitch distance between adjacent ribs, grooves and/or rib-and-groove features may vary. In some examples, the pitch distance is uniform for all of the successive pairs of ribs, grooves and/or rib-and-groove features around the circumference of the suspension element, so that the features are regularly spaced. In other examples, the pitch distance could vary between successive pairs.

The path of the grooves, ribs and rib-and-groove features may be straight or may comprise a plurality of sections and a plurality of transition regions. The angle of orientation of each section, where angle of orientation is defined as the angle of the section at the point along the section closest to the inner edge, to a normal to the inner edge that intersects the closest point, as well as the radius of curvature of the path section, can vary. The radius of curvature of the path section can vary over the section. Transition regions can smoothly join the ends of adjacent path sections. For the case where the radius of curvature at the end of one section and the beginning of the section to which it is joined have opposite sign, the transition region may include an inflection point. The number of inflection points in a groove, rib, or rib-and-groove feature path may vary.

Figure 9:
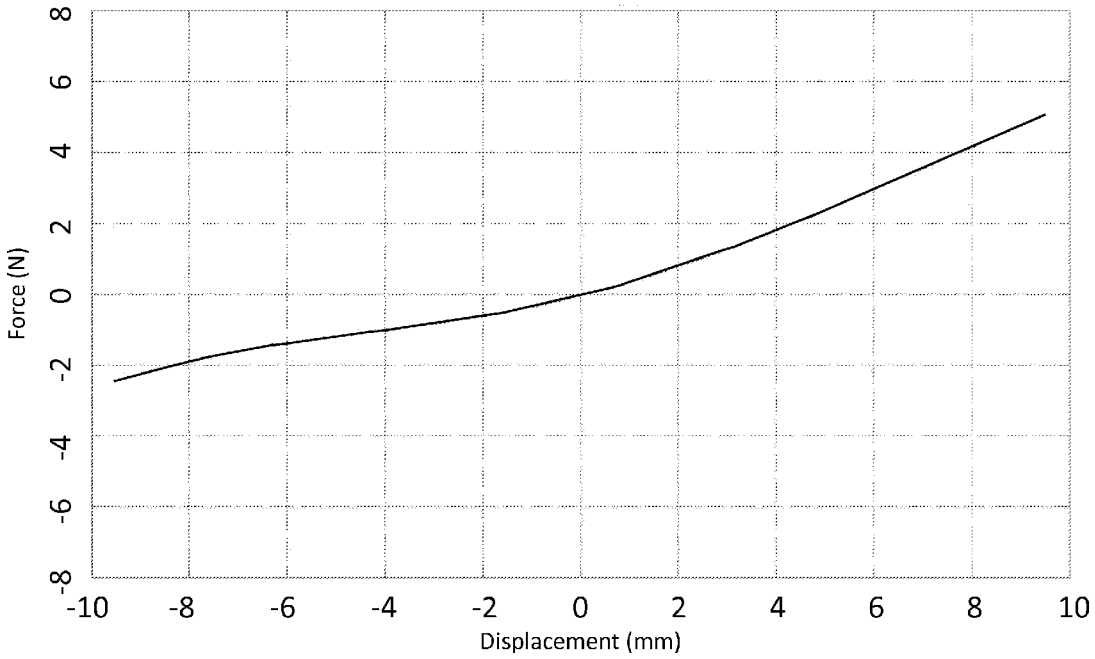
FIG. 9 illustrates an exemplary force versus displacement curve for a suspension element of similar dimensions and materials to the suspension element of FIG. 1, but without the rib-and-groove features.
Figure 10:
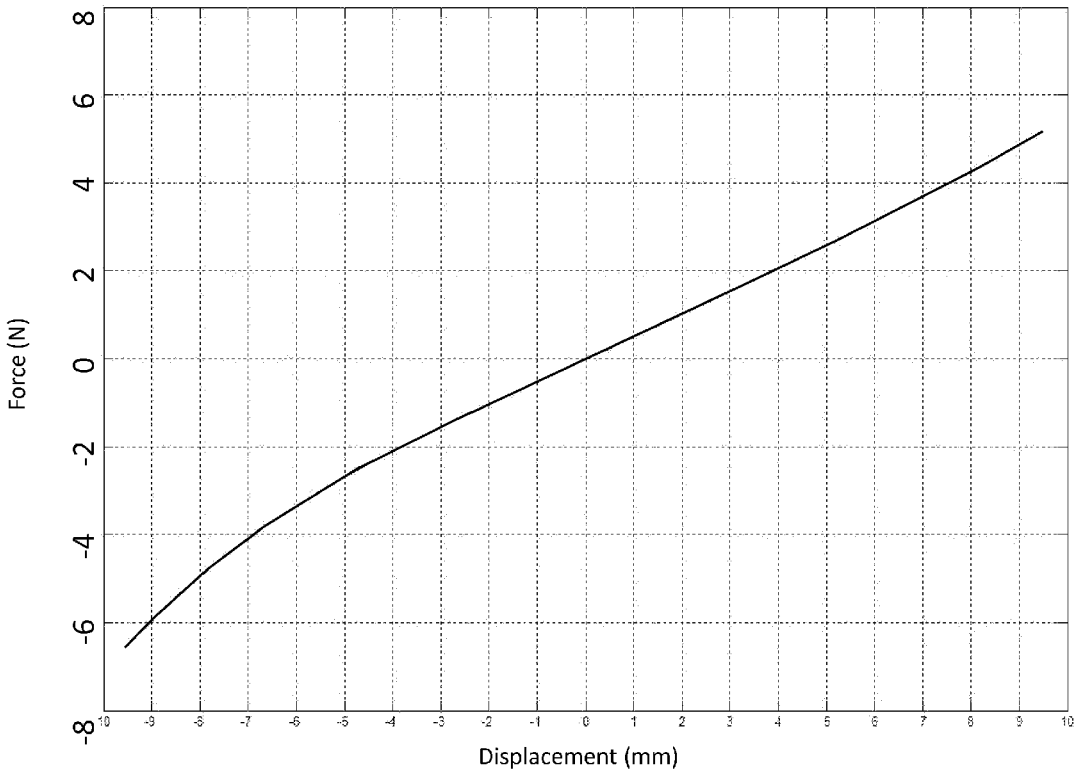
FIG. 10 illustrates an exemplary force versus displacement curve for the suspension element of FIG. 1.

The rib, groove and rib-and-groove features described above provide added stiffness in the primary axis of vibration (Z-axis). More particularly, the outer segments 504 (the rib portions) of the rib-and-groove feature 500 provide additional axial stiffness in the direction of the interior of the enclosure. In general, a suspension element having only radial grooves can undergo greater excursion without non-circumferential distortion in comparison with a suspension element of similar dimensions and materials, but without radial grooves. FIG. 9 illustrates an exemplary force versus displacement curve for such a suspension element. Note the asymmetry of the curve in different directions of excursion, e.g., +2.9 N of force at +6.0 mm excursion and −1.4 N of force at −6.0 mm of excursion. Suspension element 104 can undergo similar excursion without non-circumferential distortion, and also exhibits more symmetrical force versus displacement in comparison with a suspension element with only radial grooves. FIG. 10 illustrates an exemplary force versus displacement curve for the suspension element 104. Note the enhanced symmetry of the curve in different directions of excursion, e.g., +3.2 N of force at +6.0 mm excursion and −3.4 N of force at −6.0 mm of excursion.

Figure 11A:
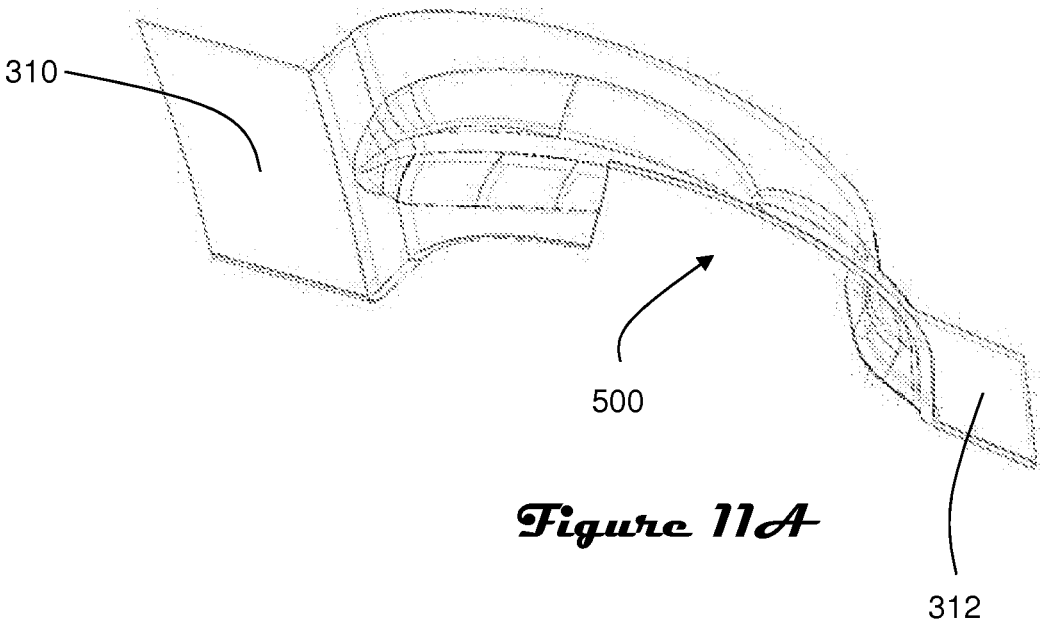
FIGS. 11A and 11B illustrate a portion of a rib-and-groove feature of FIG. 1.
Figure 11B:
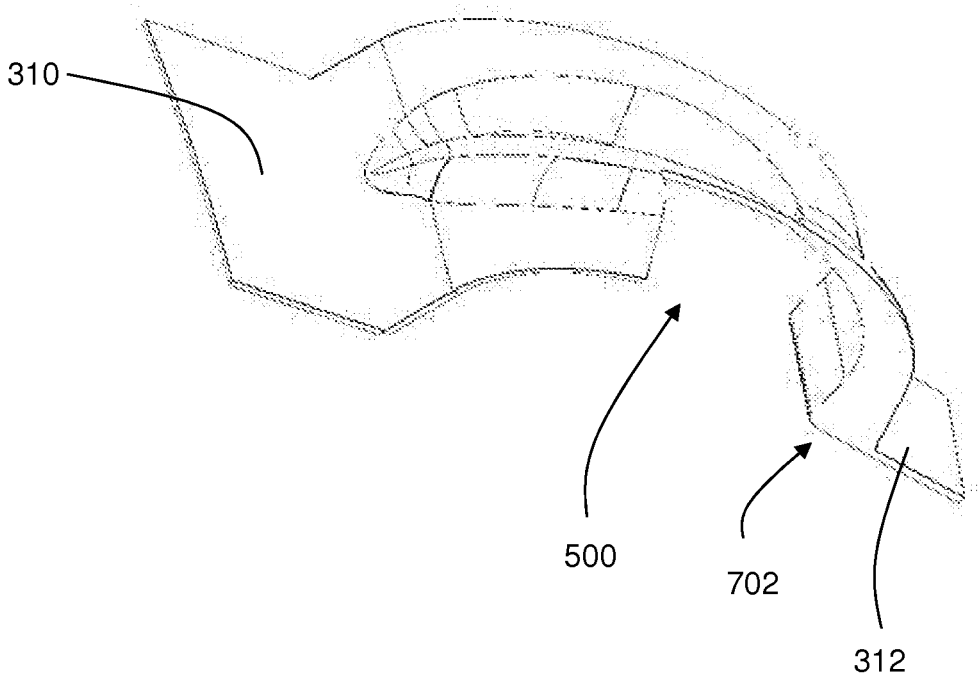

Among the wide variety of variations that are contemplated are variations of placement of the radial features. For example, the number of radial features, spacing between radial features and all dimensions of radial feature geometry could be varied. Further, the radial features are not limited to grooves and rib-and-groove features, but may also include ribs, and more than two different types might be utilized. Further, all of the radial features could be characterized by inflexions of concavity, e.g., in a manner similar to that of the rib-and-groove features 500. The ends of the radial features could be in any of various locations. In one example, the rib-and-groove features 500 traverse the roll from approximately the inner edge 306 to the outer edge 308 whereas the groove features 304 traverse the roll from a point offset from the inner edge 306 to the outer edge 308. Moreover, the maximum extent of the radial features could be varied, and transitions from zero protrusion to the maximum extent could be defined by any of various mathematical functions. Further, material thickness could be varied at the radial features and within individual radial features. For example, referring to FIG. 11A, in examples where the rib-and-groove feature 500 has a substantially uniform thickness, the outer segment 504 of the rib-and-groove features 500 may extend onto the outer landing 312 (as shown in FIG. 6B). Consequently, a perimeter defined by the outer edge 308 of the suspension element 104 may be non-circular, including V-shaped protrusions (as shown in FIG. 2). These V-shaped protrusions may be undesirable from the standpoint of manufacturability. Thus, in some implementations, as shown in FIG. 11B, the material used to create the suspension element 104 is under-compressed at least at the portion 702 where the outer segment 504 meets the outer landing 312 of the suspension element 104, thereby eliminating the V-shaped portions. Accordingly, the rib-and-groove feature 500 has varying material thickness along the length of the outer segment 504 (the rib portion). More particularly, the rib-and-groove feature 500 has increased material thickness in at least a portion 702 of the outer segment 504 proximate to the outer landing 312.

A number of implementations have been described in the above examples, but it will be understood by those of ordinary skill in the art that a wide variety of modifications and variations are possible without departing from the concepts herein disclosed. Moreover, all examples, features and aspects can be combined in any technically possible way. Accordingly, other implementations are within the scope of the following claims.

What is claimed is:

1. An apparatus comprising:

first and second rigid elements; and a suspension element which couples the first rigid element to the second rigid element such that the first rigid element is movable in a reciprocating manner relative to the second rigid element, the suspension element comprising a concave surface, a convex surface facing away from an interior of an enclosure which can be coupled to the second rigid element, and at least first and second radial segments of opposite concavity, the first segment extending away from the concave surface and the second segment extending away from the convex surface.

2. The apparatus of claim 1 in which the first and second radial segments are oriented such that lines which bisect the segments lengthwise are tangential to a circle with a radius less than an inner radius of the suspension element.

3. The apparatus of claim 2 further comprising a first radial feature comprising the first and second radial segments of opposite concavity.

4. The apparatus of claim 3 further comprising a second radial feature which extends away from the concave surface.

5. The apparatus of claim 4 wherein the first and second radial features traverse a semi-circular roll of the suspension element.

6. The apparatus of claim 5 wherein the first and second radial features are presented in alternation.

7. The apparatus of claim 6 wherein the second radial segment extends from an apex of the roll to an outer edge of the roll.

8. The apparatus of claim 7 wherein the second radial segment is characterized by a curved cross-section with a minimum height proximate to the apex of the roll and a maximum height proximate to the outer edge of the roll.

9. The apparatus of claim 8 wherein the first radial segment extends from an inner edge of the roll to the apex of the roll.

10. The apparatus of claim 9 wherein the first radial segment is characterized by a curved cross-section with a maximum depth proximate to a midpoint between the apex of the roll and the inner edge of the roll.

11. The apparatus of claim 10 wherein the second radial feature is characterized by a curved cross-section with a maximum depth proximate to the apex of the roll.

12. The apparatus of claim 5 wherein the first and second radial features span only a portion of the distance between an inner edge and outer edge of the roll.

13. The apparatus of claim 1 wherein the suspension element comprises a rolled shape.

14. The apparatus of claim 13 wherein the rolled shape comprises two or more rolls.

15. The apparatus of claim 6 wherein the first and second radial features are spaced regularly along the suspension element.

16. The apparatus of claim 4 wherein the second radial feature has a depth that varies along a length of the second radial feature.

17. The apparatus of claim 1 wherein the suspension element comprises a surround.

18. The apparatus of claim 1 wherein the suspension element comprises a spider.

19. The apparatus of claim 1 wherein a material thickness of the second radial segment varies along a length of the second radial segment.

20. The apparatus of claim 19 wherein the thickness of the second radial segment is greatest at the portion of the second radial segment proximate to an outer edge of the roll.

21. An apparatus comprising:

a diaphragm;

a frame; and a suspension element which couples the diaphragm to the frame such that the diaphragm is movable in a reciprocating manner relative to the frame, the suspension element comprising a roll which defines a concave surface and a convex surface facing away from an interior of an enclosure which can be coupled to the frame, the roll comprising:

a first feature having inner and outer ends proximate to an inner edge of the roll and an outer edge of the roll, respectively, and first and second segments of opposite concavity, the first segment extending away from the concave surface and the second segment extending away from the convex surface.

22. The apparatus of claim 21 wherein the first feature comprises the first and second segments of opposite concavity.

23. The apparatus of claim 22 wherein the roll further comprises a second feature which extends away from the concave surface.

24. The apparatus of claim 23 wherein the first and second features are oriented such that lines which bisect the features lengthwise are tangential to a circle with a radius less than an inner radius of the suspension element.

25. The apparatus of claim 24 wherein the second segment extends from an apex of the roll to an outer edge of the roll.

26. The apparatus of claim 25 wherein the second segment is characterized by a curved cross-section with a minimum height proximate to the apex of the roll and a maximum height proximate to the outer edge of the roll.

27. The apparatus of claim 26 wherein the first segment is characterized by a curved cross-section with a maximum depth proximate to a midpoint between the apex of the roll and an inner edge of the roll, and minimum depths proximate to the apex of the roll and the inner edge of the roll.

28. The apparatus of claim 27 wherein the second feature is characterized by a curved cross-section with a maximum depth proximate to the apex of the roll, and minimum depths proximate to the inner edge of the roll and the outer edge of the roll.

29. The apparatus of claim 23 wherein the first and second features are presented in alternation.

30. A loudspeaker suspension comprising:

a loudspeaker suspension structure having an inner circumferential border and an outer circumferential border, the suspension structure comprising a convex surface facing away from an interior of an enclosure which can be coupled to a frame, and a first feature extending from the inner circumferential border to the outer circumferential border, wherein the first feature comprises a first segment having a first concavity and a second segment having a second concavity, the second concavity being an inverse of the first concavity, one of the segments extending away from the convex surface.

31. The loudspeaker suspension of claim 30 further comprising a second feature extending from the inner circumferential border to the outer circumferential border and having the first concavity.

32. The loudspeaker suspension of claim 31 wherein the first and second features are oriented such that lines which bisect the features lengthwise are tangential to a circle with a radius less than an inner radius of the suspension structure.

33. The loudspeaker suspension of claim 32 wherein the first and second features are presented in alternation.

34. The loudspeaker suspension of claim 30 wherein the suspension structure comprises a roll.

35. The loudspeaker suspension of claim 34 wherein the first feature transitions from the first concavity to the second concavity proximate to an apex of the roll.

36. The loudspeaker suspension of claim 31 wherein the first and second features span only a portion of the distance between the inner circumferential border and the outer circumferential border.

* * * * *